US009028599B2

(12) United States Patent
Abe

(10) Patent No.: US 9,028,599 B2
(45) Date of Patent: May 12, 2015

(54) COPPER FILM-FORMING COMPOSITION, AND METHOD FOR PRODUCING COPPER FILM BY USING THE COMPOSITION

(71) Applicant: Adeka Corporation, Tokyo (JP)

(72) Inventor: Tetsuji Abe, Tokyo (JP)

(73) Assignee: Adeka Corporation, Arakawa-Ku (JP)

( * ) Notice: Subject to any disclaimer, the term of this patent is extended or adjusted under 35 U.S.C. 154(b) by 0 days.

(21) Appl. No.: 14/452,895

(22) Filed: Aug. 6, 2014

(65) Prior Publication Data

US 2014/0349017 A1 Nov. 27, 2014

Related U.S. Application Data

(63) Continuation of application No. PCT/JP2013/054299, filed on Feb. 21, 2013.

(30) Foreign Application Priority Data

Mar. 16, 2012 (JP) ..... 2012-060536

(51) Int. Cl.
*C23C 18/08* (2006.01)
*B05D 3/02* (2006.01)
*H01B 1/22* (2006.01)

(52) U.S. Cl.
CPC *H01B 1/22* (2013.01); *C23C 18/08* (2013.01); *B05D 3/0254* (2013.01)

(58) Field of Classification Search
CPC ..... C23C 18/08; B05D 3/0254
USPC ..... 106/1.18; 252/519.21; 427/383.1
See application file for complete search history.

(56) References Cited

U.S. PATENT DOCUMENTS

| | | | | |
|---|---|---|---|---|
| 4,913,938 | A | 4/1990 | Kawakami et al. | |
| 6,426,020 | B1 * | 7/2002 | Okada et al. | 252/79.1 |
| 8,003,814 | B2 * | 8/2011 | Wada et al. | 106/1.25 |
| 2008/0178761 | A1 | 7/2008 | Tomotake et al. | |

FOREIGN PATENT DOCUMENTS

| | | | |
|---|---|---|---|
| JP | 01-168865 | A1 | 7/1989 |
| JP | 01-168866 | A1 | 7/1989 |
| JP | 01-168867 | A1 | 7/1989 |
| JP | 01-168868 | A1 | 7/1989 |
| JP | 2004-162110 | A1 | 6/2004 |
| JP | 2007-035353 | A1 | 2/2007 |
| JP | 2008-205430 | A1 | 9/2008 |
| JP | 2009-256218 | A1 | 11/2009 |
| JP | 2010-242118 | A1 | 10/2010 |

OTHER PUBLICATIONS

International Search Report (Application No. PCT/JP2013/054299) dated Apr. 2, 2013.

* cited by examiner

*Primary Examiner* — Helene Klemanski

(74) *Attorney, Agent, or Firm* — Burr & Brown, PLLC

(57) ABSTRACT

Provided is a copper film-forming composition, which is in the form of a solution and can obtain a copper film having sufficient electrical conductivity when heated at a relatively low temperature. This copper film-forming composition contains 0.01 to 3.0 mol/kg of copper formate or its hydrate, 0.01 to 3.0 mol/kg of copper acetate or its hydrate, at least one diol compound selected from a group of diols of formula (1) and diols of formula (1'), a piperidine compound of formula (2), and an organic solvent. When a content of the copper formate or its hydrate is assumed to be 1 mol/kg, the diol compound is contained in a range of 0.1 to 6.0 mol/kg and the piperidine compound is contained in a range of 0.1 to 6.0 mol/kg.

Formula (1)

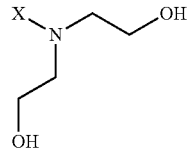

Formula (1')

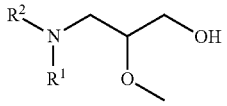

Formula (2)

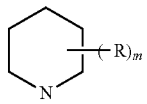

8 Claims, No Drawings

COPPER FILM-FORMING COMPOSITION, AND METHOD FOR PRODUCING COPPER FILM BY USING THE COMPOSITION

TECHNICAL FIELD

This invention relates to a copper film-forming composition for forming copper films on various substrates, and also to a process for forming a copper film by applying the composition onto a substrate and heating the same.

BACKGROUND ART

Numerous reports have been made on technologies for the formation of electrically conductive layers or wirings, which use copper as an electrical conductor, by a metal organic decomposition process (MOD process) or fine particle dispersion deposition process as a liquid process.

Processes for producing a series of articles with a copper firm formed thereon are proposed, for example, in Patent Documents 1 to 4. These processes are each characterized by applying a liquid mixture, which contains copper hydroxide or an organic acid copper salt and a polyhydric alcohol as essential components, onto one of various substrates, and heating the substrate at a temperature of 165° C. or higher in a non-oxidizing atmosphere. For use in such liquid processes, copper formate is disclosed as an organic acid copper salt, and diethanolamine and triethanolamine are disclosed as polyhydric alcohols.

Patent Document 5 contains a proposal on a metal paste, which contains fine silver particles and a copper-containing organic compound and can form a metal film of excellent solder heat resistance on an underlying electrode. As the copper-containing organic compound for use in the paste, copper formate is disclosed, and as an amino compound to be reacted with copper formate to prepare a paste, diethanolamine is disclosed.

In Patent Document 6, a proposal is made on a metal salt mixture for forming a metal pattern useful as a circuit. As components that make up the mixture, copper formate is disclosed as a metal salt in addition to organic components. As the organic components, diethanolamine, N-methyldiethanolamine, N-ethyldiethanolamine and morpholine are disclosed as organic solvents, and pyridine is disclosed as a ligand for the metal.

Patent Document 7 discloses a low temperature-degradable, copper precursor composition useful for the formation of electronic wirings or a like purpose. The composition contains copper formate and a 3-dialkylaminopropane-1,2-diol compound, both of which are thermally degradable at low temperatures after printing.

Disclosed in Patent Document 8 is a composition for forming a thin copper film. The composition contains copper formate and an alkanolamine, and is useful in the above-mentioned liquid processes. As alkanolamines, monoethanolamine, diethanolamine and triethanolamine are exemplified.

PRIOR ART DOCUMENTS

Patent Documents

Patent Document 1: JP-A-1-168865
Patent Document 2: JP-A-1-168866
Patent Document 3: JP-A-1-168867
Patent Document 4: JP-A-1-168868
Patent Document 5: JP-A-2007-35353

Patent Document 6: JP-A-2008-205430
Patent Document 7: JP-A-2009-256218
Patent Document 8: JP-A-2010-242118

DISCLOSURE OF THE INVENTION

Problem to be Solved by the Invention

To economically produce fine wirings or thin films in a liquid process that uses a copper film-forming composition, it is desired to provide a composition that satisfies the requirements to be described hereinafter. Described specifically, the composition is desired to be of a solution type which is free of a solid phase such as fine particles, to provide a copper film excellent in electrical conductivity, to be convertible to a copper film at a low temperature, to be good in coating properties, to be good in storage stability, and to be easy to control the thickness of a film to be obtained by a single application, especially to permit forming a thick film through a single application. However, no copper film-forming composition is known yet to fully satisfy all of these requirements.

Therefore, an object of the present invention is to provide a copper film-forming composition which fully satisfies all of the above-described requirements. A more specific object of the present invention is to provide a copper film-forming composition which is in the form of a solution free of a solid phase such as fine particles and can obtain a copper film of sufficient electrical conductivity when applied onto a substrate and heated at a relatively low temperature. Another more specific object of the present invention is to provide a copper film-forming composition which by similarly adjusting the concentration of copper in its components, can control the thickness of a film to be obtained through a single application and can conveniently perform the production of a copper film with a desired thickness.

Means for Solving the Problem

As a result of a great deal of consideration with the above-described circumstances in view, the present inventors found that a copper film-forming composition, which contains copper formate or a hydrate thereof, copper acetate or a hydrate thereof, a diol compound having a specific structure and a piperidine compound having a specific structure in particular proportions, satisfies the above-described required performance, leading to the present invention.

Described specifically, the present invention provides a copper film-forming composition comprising, as essential components, 0.01 to 3.0 mol/kg of copper formate or a hydrate thereof, 0.01 to 3.0 mol/kg of copper acetate or a hydrate thereof, at least one diol compound selected from the group consisting of diol compounds represented by the below-described formula (1) and diol compounds represented by the below-described formula (1'), a piperidine compound represented by the below-described formula (2), and an organic solvent with the copper formate or the hydrate thereof, the copper acetate or the hydrate thereof, the at least one diol compound and the piperidine compound dissolved therein, wherein, when a content of the copper formate or the hydrate thereof is assumed to be 1 mol/kg, the diol compound is contained in a range of 0.1 to 6.0 mol/kg and the piperidine compound is contained in a range of 0.1 to 6.0 mol/kg:

Formula (1)

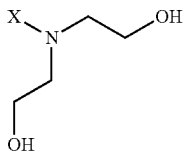

Formula (1′)

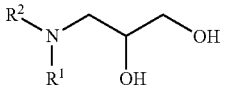

wherein X denotes a hydrogen atom, methyl group, ethyl group or 3-aminopropyl group, and $R^1$ and $R^2$ each independently indicate a hydrogen atom or an alkyl group having 1 to 4 carbon atoms or may be fused together to form a 5-membered ring or 6-membered ring in combination with the adjacent nitrogen atom, and Formula (2)

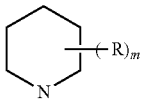

wherein R represents a methyl group or ethyl group, and m stands for 0 or 1.

The present invention also provides a process for producing a copper film, comprising the following steps: applying, onto a substrate, the above-described copper film-forming composition, and then heating the substrate at 100 to 400° C. to form a copper film.

Advantageous Effects of the Invention

According to the present invention, a copper film-forming composition is provided, which is in the form of a solution free of a solid phase such as fine particles and can obtain a copper film of sufficient electrical conductivity when applied onto a substrate and heated at a relatively low temperature. By suitably adjusting the concentrations of the copper formate or the hydrate thereof and the copper acetate or the hydrate thereof, the copper film-forming composition according to the present invention can control the thickness of a film to be obtained through a single application, and therefore, can produce a copper film with a desired thickness.

MODES FOR CARRYING OUT THE INVENTION

One of characteristic features of the copper film-forming composition according to the present invention resides in the use of copper formate as a precursor for a copper film. Copper formate for use in the present invention may be a non-hydrate or may be hydrated. Specifically, anhydrous copper(II) formate, copper(II) formate dihydrate, copper(II) formate tetrahydrate, and the like can be used. Such copper formate may be mixed as it is, or may be mixed as an aqueous solution, a solution in an organic solvent, or a suspension in an organic solvent.

The content of copper formate in the copper film-forming composition according to the present invention may be adjusted as desired according to the thickness of a desired copper film. For example, the content of copper formate may be preferably 0.01 to 3.0 mol/kg, more preferably 0.1 to 2.5 mol/kg.

Here, it is to be noted that the term "mol/kg" as used herein means "the physical quantity of a solute dissolved per kg of solution". For example, when copper formate and copper acetate are dissolved as much as 63.55 g in terms of copper in 1 kg of the copper film-forming composition according to the present invention, the copper concentration is considered to be 1.0 mol/kg. When 153.58 g of copper formate is dissolved in 1 kg of the copper film-forming composition according to the present invention, the copper concentration is likewise considered to be 1.0 mol/kg because the molecular weight of copper(II) formate is 153.58.

Another one of the characteristic features of the present invention resides in the use of copper acetate as a control agent for the concentration of copper in combination with copper formate described above. Copper acetate for use in the present invention may be a non-hydrate or may be hydrated. Specifically, anhydrous copper(II) acetate, copper(II) acetate monohydrate, and the like can be used. Like copper formate, such copper acetate may be mixed as it is, or may be mixed as an aqueous solution, a solution in an organic solvent, or a suspension in an organic solvent. According to a study by the present inventors, the formulation of a copper film-forming composition by making combined use of copper formate in addition to copper acetate can provide the resulting copper film with improved electrical properties. When copper(II) acetate monohydrate (molecular weight: 199.65) is used, for example, its inclusion at 1.0 mol/kg means that 199.65 g of copper(II) acetate monohydrate is contained in 1 kg of the copper film-forming composition according to the present invention as described above.

According to another study by the present inventors, the combined use of copper acetate in addition to copper acetate can obtain a copper film-forming composition of a lower viscosity compared with the preparation of a copper film-forming composition of the same copper concentration from copper formate alone. When a copper film-forming composition is used as a coating formulation in a coating method represented by inkjet coating or spin coating, a higher viscosity may generally lead to deteriorations in coating properties. In contrast to this, the copper film-forming composition according to the present invention can remain low in viscosity and can maintain coating properties even when its copper concentration is high.

As copper acetate has very high solubility in the copper film-forming composition, the concentration of copper in the copper film-forming composition can be made high compared with the control of the concentration of copper with copper formate alone in the copper film-forming composition. The concentration of copper in the copper film-forming composition gives a significant effect on the thickness of a copper film to be formed by a coating method. In contrast to this, the copper film-forming composition according to the present invention has high stability and high coating properties even when the concentration of copper is high, and therefore, is also excellent in the controllability of the thickness of a copper film to be obtained from the composition. When a copper film is produced, for example, with the copper film-forming composition according to the present invention by such a coating method as described above, the copper film can be formed as a smooth, electrically conductive film having an appropriate thickness in a wide range of several tens to 1,000 nm by a single application.

The content of copper acetate in the copper film-forming composition according to the present invention may be adjusted as desired according to the thickness of a desired copper film. The content of copper acetate may be preferably in a range of 0.01 to 3.0 mol/kg, with 0.1 to 2.5 mol/kg being more preferred.

No particular limitation is imposed on the concentration ratio of copper formate to copper acetate in the copper film-forming composition according to the present invention. Preferably however, the composition may be prepared such that 40% or more of the whole copper concentration in the composition is attributable to the addition of copper formate. Further, a substantially equal (1:1) concentration ratio of copper formate to copper acetate can obtain a film of excellent electrical characteristics, and therefore, is particularly preferred.

The dial compound, which is represented by the below-described formula (1) or (1') and is a component that makes up the copper film-forming composition according to the present invention, is characterized by having one or more amino groups. According to a further study by the present inventors, the diol compound exhibits effectiveness as a solubilizer for copper formate or a copper formate hydrate, provides the copper film-forming composition with storage stability, and further, is effective in providing improved electrical conductivity when converted to a film.

Formula (1)

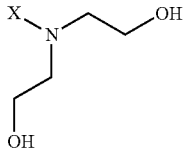

Formula (1')

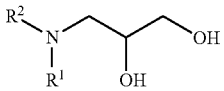

In the formula (1), X denotes a hydrogen atom, methyl group, ethyl group or 3-aminopropyl group. In the formula (1'), on the other hand, $R^1$ and $R^2$ each independently indicate a hydrogen atom or an alkyl group having 1 to 4 carbon atoms or may be fused together to form a 5-membered ring or 6-membered ring in combination with the adjacent N. As the alkyl group having 1 to 4 carbon atoms, methyl, ethyl, propyl, 2-propyl, butyl, 2-butyl, isobutyl, or tertiary butyl can be mentioned. Examples of the 5- or 6-membered ring, which $R^1$ and $R^2$ may form by their fusion together in combination with the adjacent N, include pyrrole, pyrrolidine, methylpyrrolidine, pyridine, 2-methylpyridine, 3-methylpyridine, 4-methylpyridine, 2,4-lutidine, 2,6-lutidine, piperidine, 2-methylpiperidine, 3-methylpiperidine, and 4-methylpiperidine.

Examples of the diol compound represented by the formula (1) include the following compound No. 1 to No. 4.

Compound No. 1

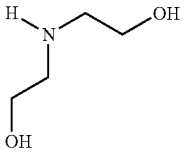

-continued

Compound No. 2

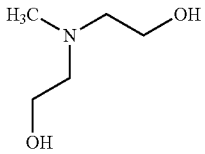

Compound No. 3

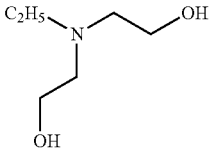

Compound No. 4

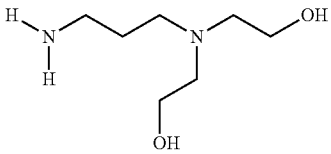

Examples of the diol compound represented by the formula (1') include the following compound No. 5 to No. 13.

Compound No. 5

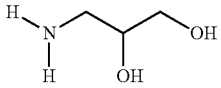

Compound No. 6

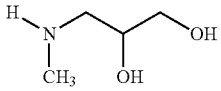

Compound No. 7

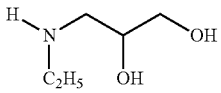

Compound No. 8

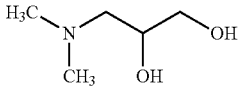

Compound No. 9

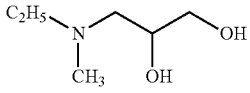

Compound No. 10

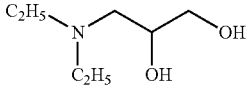

Compound No. 11

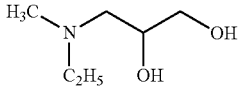

Compound No. 12

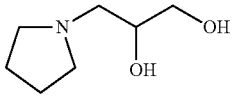

Compound No. 13

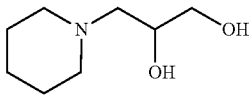

Among the above-enumerated diol compounds, diethanolamine (Compound No. 1), N-methyldiethanolamine (Compound No. 2), N-ethyldiethanolamine (Compound No. 3), N-aminopropyldiethanolamine (Compound No 4) and 3-dimethylamino-1,2-propanediol (Compound No. 8) are preferred because they provide the resulting copper film-forming compositions with particularly good storage stability. Further, diethanolamine (Compound No. 1), N-methyldiethanolamine (Compound No. 2), N-ethyldiethanolamine (Compound No. 3) and N-aminopropyldiethanolamine (Compound No 4) are particularly preferred because their uses provide the resulting films with good electrical conductivity.

Among those enumerated above, N-methyldiethanolamine (Compound No. 2) is still more preferred because its use enables the conversion to a copper film at a low heating temperature.

The content of the above-described diol compound in the copper film-forming composition according to the present invention is required to be in a range of 0.1 to 6.0 mol/kg when the content of the copper formate or the hydrate thereof is assumed to be 1 mol/kg. A content lower than 0.1 mol/kg provides the resulting copper film with insufficient electrical conductivity, while a content higher than 6.0 mol/kg leads to deteriorations in coating properties so that no uniform copper film can be obtained. A more preferred range is 0.2 to 5.0 mol/kg. The above-described diol compounds may be used either singly or as a combination of two or more thereof.

The piperidine compound represented by the below-described formula (2), which is an essential component for the copper film-forming composition according to the present invention, provides the resulting copper film-forming composition with good coating properties and storage stability when it is incorporated.

Formula (2)

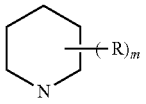

wherein R represents a methyl group or ethyl group, and m stands for 0 or 1.

Examples of the piperidine compound represented by the formula (2), which constitutes the present invention, include the following compound No. 14 to No. 20.

Compound No. 14

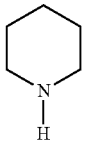

Compound No. 15

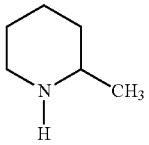

-continued

Compound No. 16

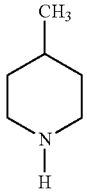

Compound No. 17

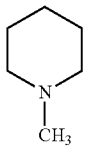

Compound No. 18

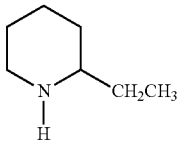

Compound No. 19

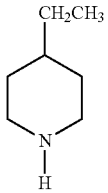

Compound No. 20

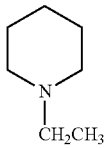

Among the above-exemplified piperidine compounds, the use of the compound No. 15 is particularly preferred in the present invention. A copper film-forming composition equipped with especially good coating properties and storage stability can be obtained by using the compound No. 15.

The content of the above-described piperidine compound in the copper film-forming composition according to the present invention is required to be in a range of 0.1 to 6.0 mol/kg when the content of copper formate is assumed to be 1 mol/kg. A content lower than 0.1 mol/kg leads to deteriorations in coating properties so that no uniform copper film can be obtained, while a content higher than 6.0 mol/kg provides the resulting copper film with insufficient electrical conductivity. A more preferred range of the content of the piperidine compound is 0.2 to 5.0 mol/kg.

According to a still further study by the present inventors, it is preferred to control the sum of the contents of the diol compound and piperidine compound in a range of 0.5 to 2.0 mol/kg in the copper film-forming composition according to the present invention when the sum of the used amounts of copper formate and copper acetate is assumed to be 1 mol/kg, because the composition is provided with good coating properties and storage stability and the resulting film is provided with good electrical conductivity. A sum smaller than 0.5 mol/kg may result in the occurrence of a precipitate, while a sum greater than 2 mol/kg may lead to deteriorations in coating properties. Neither such an excessively small sum nor such an unduly great sum is preferred accordingly. A more preferred range of the sum of the contents of the diol compound and piperidine compound may be 1 to 1.5 mol/kg.

No particular limitation is imposed on the concentration ratio of the diol compound to the piperidine compound in the copper film-forming composition according to the present invention. Preferably, however, the concentration of piperidine compound may be in a range of 0.5 to 1.5 mol/kg when the concentration of the diol compound is assumed to be 1 mol/kg. It is particularly preferred when the concentration of the piperidine compound is 1 mol/kg (substantially equal to that of the diol compound), because the resulting solution is good in stability and can obtain a film excellent in electrical characteristics.

As the organic solvent that makes up the copper film-forming composition according to the present invention, any organic solvent is usable insofar it can stably dissolve the diol compound and piperidine compound. The organic solvent can be either a single component system or a mixture. Examples of the organic solvent for use in the composition according to the present invention include alcohol-based solvents, diol-based solvents, ketone-based solvents, ester-based solvents, ether-based solvents, aliphatic or alicyclic hydrocarbon-based solvents, aromatic hydrocarbon-based solvents, cyano-containing hydrocarbon solvents, and other solvents.

Illustrative of the alcohol-based solvents are methanol, ethanol, propanol, isopropanol, 1-butanol, isobutanol, 2-butanol, tertiary butanol, pentanol, isopentanol, 2-pentanol, neopentanol, tertiary pentanol, hexanol, 2-hexanol, heptanol, 2-heptanol, octanol, 2-ethlhexanol, 2-octanol, cyclopentanol, cyclohexanol, cycloheptanol, methylcyclopentanol, methylcyclohexanol, methylcycloheptanol, benzyl alcohol, ethylene glycol monoacetate, ethylene glycol monoethyl ether, ethylene glycol monophenyl ether, ethylene glycol monobutyl ether, ethylene glycol monomethyl ether, propylene glycol monomethyl ether, propylene glycol monoethyl ether, diethylene glycol monomethyl ether, diethylene glycol monoethyl ether, dipropylene glycol monomethyl ether, dipropylene glycol monoethyl ether, dipropylene glycol monobutyl ether, 2-(2-methoxyethoxy)ethanol, 2-(N,N-dimethylamino)ethanol, 3-(N,N-dimethylamino)propanol, and the like.

Illustrative of the diol-based solvents are ethylene glycol, propylene glycol, 1,2-butanediol, 1,3-butanediol, 1,4-butanediol, 1,5-pentanediol, neopentyl glycol, isoprene glycol (3-methyl-1,3-butanediol), 1,2-hexanediol, 1,6-hexanediol, 3-methyl-1,5-pentanediol, 1,2-octanediol, octanediol (2-ethyl-1,3-hexanediol), 2-butyl-2-ethyl-1,3-propanediol, 2,5-dimethyl-2,5-hexanediol, 1,2-cyclohexanediol, 1,4-cyclohexanediol, 1,4-cyclohexanedimethanol, and the like.

Illustrative of the ketone-based solvents are acetone, ethyl methyl ketone, methyl butyl ketone, methyl isobutyl ketone, ethyl butyl ketone, dipropyl ketone, diisobutyl ketone, methyl amyl ketone, cyclohexanone, methylcyclohexanone, and the like.

Illustrative of the ester-based solvents are methyl formate, ethyl formate, methyl acetate, ethyl acetate, isopropyl acetate, butyl acetate, isobutyl acetate, sec-butyl acetate, tert-butyl acetate, amyl acetate, isoamyl acetate, tert-amyl acetate, phenyl acetate, methyl propionate, ethyl propionate, isopropyl propionate, butyl propionate, isobutyl propionate, sec-butyl propionate, tert-butyl propionate, amyl propionate, isoamyl propionate, tert-amyl propionate, phenyl propionate, methyl 2-ethylhexanoate, ethyl 2-ethylhexanoate, propyl 2-ethylhexanoate, isopropyl 2-ethylhexanoate, butyl 2-ethylhexanoate, methyl lactate, ethyl lactate, methyl methoxypropionate, methyl ethoxypropionate, ethyl methoxypropionate, ethyl ethoxypropionate, ethylene glycol monomethyl ether acetate, diethylene glycol monomethyl ether acetate, ethylene glycol monoethyl ether acetate, ethylene glycol monopropyl ether acetate, ethylene glycol monoisopropyl ether acetate, ethylene glycol monobutyl ether acetate, ethylene glycol mono-sec-butyl ether acetate, ethylene glycol monoisobutyl ether acetate, ethylene glycol mono-tert-butyl ether acetate, propylene glycol monomethyl ether acetate, propylene glycol monoethyl ether acetate, propylene glycol monopropyl ether acetate, propylene glycol monoisopropyl ether acetate, propylene glycol monobutyl ether acetate, propylene glycol mono-sec-butyl ether acetate, propylene glycol monoisobutyl ether acetate, propylene glycol mono-tert-butyl ether acetate, butylene glycol monomethyl ether acetate, butylene glycol monoethyl ether acetate, butylene glycol monopropyl ether acetate, butylene glycol monoisopropyl ether acetate, butylene glycol monobutyl ether acetate, butylene glycol mono-sec-butyl ether acetate, butylene glycol monoisobutyl ether acetate, butylene glycol mono-tert-butyl ether acetate, methyl acetoacetate, ethyl acetoacetate, methyl oxobutanoate, ethyl oxobutanoate, γ-lactone, δ-lactone, and the like.

Illustrative of the ether-based solvents are tetrahydrofuran, tetrahydropyran, morpholine, ethylene glycol dimethyl ether, diethylene glycol dimethyl ether, triethylene glycol dimethyl ether, dibutyl ether, diethyl ether, dioxane, and the like.

The aliphatic or alicyclic hydrocarbon solvents may include pentane, hexane, cyclohexane, methylcyclohexane, dimethylcyclohexane, ethylcyclohexane, heptane, octane, decaline, solvent naphtha, and the like.

The aromatic hydrocarbon-based solvents may include benzene, toluene, ethylbenzene, xylene, mesitylene, diethylbenzene, cumene, isobutylbenzene, cymene, tetralin, and the like.

The cyano-containing hydrocarbon solvents may include 1-cyanopropane, 1-cyanobutane, 1-cyanohexane, cyanocyclohexane, cyanobenzene, 1,3-dicyanopropane, 1,4-dicyanobutane, 1,6-dicyanohexane, 1,4-dicyanocyclohexane, 1,4-dicyanobenzene, and the like.

The other organic solvents may include N-methyl-2-pyrrolidone, dimethyl sulfoxide, and dimethyl formamide.

Among the above-described organic solvents, the alcohol-based solvents, diol-based solvents and ester-based solvents are preferred in the present invention, because they are economical, show sufficient solubility to the solutes, and moreover, exhibit good coating properties as coating solvents for various substrates such as silicon substrates, metal substrates, ceramic substrates, glass substrates, and resin substrates. Of these organic solvents, those containing one or more hydroxyl groups in their structures, such as alcohol-based solvents and diol-based solvents, are particularly preferred as they have high solubility to the solutes.

The content of the organic solvent in the copper film-forming composition according to the present invention is not limited particularly, and can be adjusted as desired according to the thickness of a desired copper film and a method to be used to produce the copper film. When producing a copper film, for example, by a coating method, the organic solvent may be used preferably in a range of 0.01 parts by mass to 5,000 parts by mass per 100 parts by mass of the sum of the masses of copper formate (in terms of copper formate even in the case of a copper formate hydrate; this will apply equally hereinafter) and copper acetate (in terms of copper acetate even in the case of a copper acetate hydrate; this will apply equally hereinafter). If the content of the organic solvent is lower than 0.01 parts by mass, such an excessively low content of the organic solvent may lead to an inconvenience such that cracks occur in the resulting film or the coating properties are deteriorated, and therefore, is not preferred. As the proportion of the organic solvent increases, the resulting film becomes thinner. From the aspect of productivity, it is hence preferred not to exceed 5,000 parts by mass. Described more specifically, when producing a copper film by spin coating, it is preferred to use the organic solvent in a range of 20 parts by mass to 1,000 parts by mass per 100 parts by mass of the sum of the masses of copper formate and copper acetate. When producing a copper film by screen printing, on the other hand, it is preferred to use the organic solvent in a range of 0.01 parts by mass to 20 parts by mass per 100 parts by mass of the sum of the masses of copper formate and copper acetate.

The copper film-forming composition according to the present invention contains, as essential components, copper formate or a hydrate thereof, copper acetate or a hydrate thereof, the specific diol compound, the specific piperidine compound and the organic solvent as described above, and may additionally contain one or more optional components to such extents as not to impair the advantageous effects of the pre sent invention. Such optional components may include additives for imparting stability to the composition as a coating formulation, such as antigelling agents and stabilizing agents; additives for improving the coating properties of the composition as the coating formulation, such as defoaming agents, thickening agents, thixotropic agents and leveling agents; film-forming aids such as combustion aids and crosslinking aids; and so on. When these optional components are used, their total content may be preferably 10 mass % or lower, more preferably 5 mass % or lower.

A description will next be made about the process of the present invention for the production of a copper film.

The process of the present invention for the production of a copper film comprises an application step that the above-described copper film-forming composition according to the present invention is applied onto a substrate, and a film-forming step that the substrate is then heated at 100 to 400° C. to form a copper film. If needed, it is possible to add, before the film-forming step, a drying step that the substrate is held at 50 to 200° C. to evaporate low-boiling components such as the organic solvent, and after the film-forming step, an annealing step that the substrate is held at 200 to 500° C. to provide the resulting copper film with improved electrical conductivity.

Coating methods usable in the above-described application step may include spin coating, dip coating, spray coating, mist coating, flow coating, curtain coating, roll coating, knife coating, bar coating, slit coating, screen printing, gravure printing, offset printing, inkjet coating, brush coating, and the like.

Further, the application step to desired one of the remaining steps may be repeated a plurality of times to obtain a needed thickness. For example, the entire steps of from the application step to the film-forming step may be repeated a plurality of times, or the application step and drying step may be repeated a plurality of times.

Atmospheres for the above-described drying step, film-forming step and annealing step may each be either a reducing gas or an inert gas in general. Under the presence of a reducing gas, a copper film of superior electrical conductivity can be obtained. As the reducing gas, hydrogen can be mentioned, and as the inert gas, helium, nitrogen or argon can be mentioned. The inert gas may also be used as a diluent gas for the reducing gas. In each step, energy other than heat—such as plasma light, laser light, light from discharge lamps such as xenon lamps, mercury lamps, mercury xenon lamps, xenon flash lamps, argon flash lamps or deuterium lamps, or one of various radiations—may be applied or irradiated.

EXAMPLES

The present invention will hereinafter be described in further detail based on production examples and examples. It should, however, be borne in mind that the present invention is by no means limited by the following examples.

Example 1

The compounds described in Table 1 were formulated to give the corresponding values (mol/kg) in parentheses, whereby copper film-forming composition Nos. 1 to 12 were obtained as examples of the present invention. Described specifically, as shown in Table 1, copper formate tetrahydrate and copper acetate monohydrate were varied in amount used, while the diol compound and piperidine compound were varied in kind and amount used, so that twelve kinds of copper film-forming compositions were prepared as Nos. 1 to 12. It is to be noted that the balance is ethanol in its entirety. Further, each concentration described in Table 1 means the amount of the corresponding component used per kg of the composition so prepared (this will apply equally hereinafter).

TABLE 1

Formulas of Copper Film-forming Compositions of Example 1

| Composition numbers | Copper formate compound (mol/kg) | Copper acetate compound (mol/kg) | Diol compound (mol/kg) | Piperidine compound (mol/kg) |
|---|---|---|---|---|
| No. 1 | Copper formate tetrahydrate (0.99) | Copper acetate monohydrate (0.01) | Compound No. 2 (1.0) | Compound No. 15 (1.0) |
| No. 2 | Copper formate tetrahydrate (0.9) | Copper acetate monohydrate (0.1) | Compound No. 2 (1.0) | Compound No. 15 (1.0) |
| No. 3 | Copper formate tetrahydrate (0.7) | Copper acetate monohydrate (0.3) | Compound No. 2 (1.0) | Compound No. 15 (1.0) |
| No. 4 | Copper formate tetrahydrate (0.5) | Copper acetate monohydrate (0.5) | Compound No. 2 (1.0) | Compound No. 15 (1.0) |
| No. 5 | Copper formate tetrahydrate (0.4) | Copper acetate monohydrate (0.6) | Compound No. 2 (1.0) | Compound No. 15 (1.0) |
| No. 6 | Copper formate tetrahydrate (0.5) | Copper acetate monohydrate (0.5) | Compound No. 2 (0.6) | Compound No. 15 (0.9) |
| No. 7 | Copper formate tetrahydrate (0.5) | Copper acetate monohydrate (0.5) | Compound No. 2 (1.0) | Compound No. 15 (0.5) |
| No. 8 | Copper formate tetrahydrate (0.5) | Copper acetate monohydrate (0.5) | Compound No. 1 (0.6) | Compound No. 15 (0.6) |
| No. 9 | Copper formate tetrahydrate (0.5) | Copper acetate monohydrate (0.5) | Compound No. 3 (0.6) | Compound No. 15 (0.6) |

TABLE 1-continued

Formulas of Copper Film-forming Compositions of Example 1

| Composition numbers | Copper formate compound (mol/kg) | Copper acetate compound (mol/kg) | Diol compound (mol/kg) | Piperidine compound (mol/kg) |
|---|---|---|---|---|
| No. 10 | Copper formate tetrahydrate (0.5) | Copper acetate monohydrate (0.5) | Compound No. 8 (0.6) | Compound No. 15 (0.6) |
| No. 11 | Copper formate tetrahydrate (0.5) | Copper acetate monohydrate (0.5) | Compound No. 2 (0.6) | Compound No. 16 (0.6) |
| No. 12 | Copper formate tetrahydrate (0.5) | Copper acetate monohydrate (0.5) | Compound No. 2 (0.6) | Compound No. 15 (0.6) |

Comparative Production Example 1

The compounds described in Table 2 were formulated to give the corresponding values (mol/kg) in parentheses, whereby comparative compositions 1 to 11 were obtained. Described specifically, as shown in Table 2, the comparative compositions 1 to 9 are copper film-forming compositions each of which did not contain at least one of copper formate tetrahydrate, copper acetate monohydrate, a diol compound and a piperidine compound. Further, the comparative compositions 10 and 11 are copper film-forming compositions prepared by using copper compounds other than the copper acetate compound, respectively. It is to be noted that the balance is ethanol in its entirety.

TABLE 2

Formulas of Copper Film-forming Compositions of Comparative Production Example 2

| Comparative composition numbers | Copper formate compound (mol/kg) | Copper acetate compound or the like (mol/kg) | Diol compound (mol/kg) | Piperidine compound (mol/kg) |
|---|---|---|---|---|
| Comp. compn. 1 | Copper formate tetrahydrate (1.0) | None | Compound No. 2 (1.0) | Compound No. 15 (1.0) |
| Comp. compn. 2 | None | Copper acetate monohydrate (1.0) | Compound No. 2 (1.0) | Compound No. 15 (1.0) |
| Comp. compn. 3 | Copper formate tetrahydrate (0.5) | Copper acetate monohydrate (0.5) | None | Compound No. 15 (1.0) |
| Comp. compn. 4 | Copper formate tetrahydrate (0.5) | Copper acetate monohydrate (0.5) | Compound No. 2 (1.0) | None |
| Comp. compn. 5 | Copper formate tetrahydrate (0.5) | None | Compound No. 1 (1.0) | Compound No. 15 (1.0) |
| Comp. compn. 6 | Copper formate tetrahydrate (0.5) | None | Compound No. 3 (1.0) | Compound No. 15 (1.0) |
| Comp. compn. 7 | Copper formate tetrahydrate (0.5) | None | Compound No. 8 (1.0) | Compound No. 15 (1.0) |
| Comp. compn. 8 | Copper formate tetrahydrate (0.5) | None | Compound No. 2 (1.0) | Compound No. 16 (1.0) |
| Comp. compn. 9 | Copper formate tetrahydrate (0.5) | None | Compound No. 2 (1.0) | Compound No. 18 (1.0) |
| Comp. compn. 10 | Copper formate tetrahydrate (0.5) | Copper isobutyrate[1)] (0.5) | Compound No. 2 (0.6) | Compound No. 15 (0.6) |
| Comp. compn. 11 | Copper formate tetrahydrate (0.5) | Copper 2-ethylhexanoate[1)] (0.5) | Compound No. 2 (0.6) | Compound No. 15 (0.6) |

[1)]The composition was prepared by using a copper compound other than any copper acetate compound.

Example 2

Separately using the copper film-forming composition Nos. 1 to 12 obtained in Example 1, the production of thin copper films by a coating method was conducted. Described specifically, each composition described above was first cast on a glass substrate for a liquid crystal display screen ["Eagle XG" (trade name), product of Corning Incorporated], and was applied at 500 rpm for 5 seconds and then at 2,000 rpm for 20 seconds by spin coating. Subsequently, the glass substrate was dried at 140° C. for 30 seconds on a hot plate in the atmosphere, and the glass substrate after the drying was then heated at the corresponding predetermined temperature, which is shown in Table 3, for 20 minutes under an argon atmosphere in an infrared heating furnace ("RTP-6"; manufactured by ULVAC-RIKO, Inc.) to conduct primary heating. During the primary heating, the flow condition for argon was set at 300 mL/min, and the ramp-up rate was set at 250° C./30 sec. The thus-obtained, individual thin copper films were provided for an evaluation to be described subsequently herein. These films are shown as Evaluation Example 1-1 to Evaluation Example 1-12 in Table 3.

Comparative Production Example 2

Separately using the comparative compositions 1 to 11 obtained in Comparative Production Example 1, the production of thin copper films by a coating method was conducted. Described specifically, each composition described above was first cast on a similar glass substrate ("Eagle XG", product of Corning incorporated) as those used in Example 2, and was coated at 500 rpm for 5 seconds and then at 2,000 rpm for 20 seconds by spin coating. Subsequently, the glass substrate was dried at 140° C. for 60 seconds on a hot plate in the atmosphere, and was then heated at the corresponding predetermined temperature for 20 minutes under an argon atmosphere in an infrared heating furnace ("RTP-6"; manufactured by ULVAC-RIKO, Inc.) to conduct primary heating. During the primary heating, the flow condition for argon was set at 300 mL/min, and the ramp-up rate was set at 250° C./30 sec. The thus-obtained, individual thin copper films were provided for an evaluation to be described subsequently herein. These films are shown as Comparative Examples 1 to 11 in Table 3.

Evaluation Example 1

Concerning the respective thin copper films formed on the glass substrates as obtained in Example 2 and Comparative Production Example 2, an evaluation was performed for film conditions, surface resistivity and film thickness by the below-described methods. The conditions of each film were evaluated by a visual observation. For the measurement of the surface resistivity of each film, "LORESTA GP" (trade name; manufactured by Mitsubishi Chemical Analytech Co., Ltd.) was used. The thickness of each film was measured by observing its cross-section with FE-SEM (field emission scanning electron microscope). The results are shown all together in Table 3.

From the results of Table 3, it was able to confirm that the thin copper films of Evaluation Examples 1-1 to 1-12 were substantially lower in surface resistivity and was improved in electrical characteristics compared with the thin copper films of Comparative Examples 1 to 9. From this, it has been confirmed that the copper film-forming compositions of the examples of the present invention can obtain copper films of good electrical characteristics. On the other hand, the copper films of Comparative Examples 10 and 11, in which the copper compounds other any copper acetate compounds were used, respectively, were more deteriorated in electrical characteristics than the copper film of Comparative Example 1. It was also able to confirm that the copper film-forming compositions of the examples of the present invention were excellent in coating properties because all of the thin copper films of Evaluation Examples 1-1 to 1-12 were smooth and were glossy over their entire surfaces.

Example 3

The compounds described in Table 4 were formulated to give the corresponding values (mol/kg) in parentheses, whereby copper film-forming composition Nos. 13 to 15 were obtained as examples of the present invention. It is to be noted that the balance is ethanol in its entirety.

TABLE 3

Results of Evaluation

| Evaluated films | Copper film-forming compositions | Heating temp. (° C.) | Film conditions | Surface resistivity (Ω/□) | Film thickness (nm) |
|---|---|---|---|---|---|
| Comp. Ex. 1 | Comp. compn. 1 | 250 | Smooth, glossy over entire surface | 6.0 | 160 |
| Comp. Ex. 2 | Comp. compn. 2 | 250 | Smooth, black | —[2)] | 160 |
| Comp. Ex. 3 | Comp. compn. 3 | 250 | Smooth, glossy over entire surface | —[2)] | 150 |
| Comp. Ex. 4 | Comp. compn. 4 | 250 | Film formation impossible | —[2)] | — |
| Comp. Ex. 5 | Comp. compn. 5 | 350 | Rough with repellency | 45.4 | 330 |
| Comp. Ex. 6 | Comp. compn. 6 | 350 | Smooth, glossy over entire surface | 38.3 | 290 |
| Comp. Ex. 7 | Comp. compn. 7 | 250 | Smooth, glossy over entire surface | 112.0 | 110 |
| Comp. Ex. 8 | Comp. compn. 8 | 250 | Smooth, glossy over entire surface | 26.7 | 150 |
| Comp. Ex. 9 | Comp. compn. 9 | 250 | Smooth, glossy over entire surface | 20.0 | 150 |
| Comp. Ex. 10 | Comp. compn. 10 | 250 | Smooth, glossy over entire surface | 10.6 | 130 |
| Comp. Ex. 11 | Comp. compn. 11 | 250 | Sea-island form[3)] | —[2)] | — |
| Eval. Ex. 1-1 | Compn. No. 1 of Ex. 1 | 250 | Smooth, glossy over entire surface | 3.2 | 120 |
| Eval. Ex. 1-2 | Compn. No. 2 of Ex. 1 | 250 | Smooth, glossy over entire surface | 3.8 | 160 |
| Eval. Ex. 1-3 | Compn. No. 3 of Ex. 1 | 250 | Smooth, glossy over entire surface | 1.9 | 190 |
| Eval. Ex. 1-4 | Compn. No. 4 of Ex. 1 | 250 | Smooth, glossy over entire surface | 1.9 | 180 |
| Eval. Ex. 1-5 | Compn. No. 5 of Ex. 1 | 250 | Smooth, glossy over entire surface | 2.3 | 200 |
| Eval. Ex. 1-6 | Compn. No. 6 of Ex. 1 | 250 | Smooth, glossy over entire surface | 3.5 | 100 |
| Eval. Ex. 1-7 | Compn. No. 1 of Ex. 1 | 250 | Smooth, glossy over entire surface | 4.0 | 120 |
| Eval. Ex. 1-8 | Compn. No. 8 of Ex. 1 | 350 | Smooth, glossy over entire surface | 2.3 | 290 |
| Eval. Ex. 1-9 | Compn. No. 9 of Ex. 1 | 350 | Smooth, glossy over entire surface | 4.8 | 180 |
| Eval. Ex. 1-10 | Compn. No. 10 of Ex. 1 | 250 | Smooth, glossy over entire surface | 72.3 | 170 |
| Eval. Ex. 1-11 | Compn. No. 11 of Ex. 1 | 250 | Smooth, glossy over entire surface | 5.3 | 120 |
| Eval. Ex. 1-12 | Compn. No. 12 of Ex. 1 | 250 | Smooth, glossy over entire surface | 4.0 | 120 |

[2)]The resultant film showed no electrical conductivity.

[3)]The composition was repelled on the substrate upon application, thereby making it impossible to form a film over the entire surface of the substrate.

TABLE 4

Formulas of Copper Film-forming Compositions of Example 3

| Composition numbers | Copper formate compound (mol/kg) | Copper acetate compound (mol/kg) | Diol compound (mol/kg) | Piperidine compound (mol/kg) |
|---|---|---|---|---|
| No. 13 | Copper formate tetrahydrate (0.5) | Copper acetate monohydrate (0.5) | Compound No. 2 (0.6) | Compound No. 15 (0.6) |

TABLE 4-continued

| Formulas of Copper Film-forming Compositions of Example 3 | | | | |
|---|---|---|---|---|
| Composition numbers | Copper formate compound (mol/kg) | Copper acetate compound (mol/kg) | Diol compound (mol/kg) | Piperidine compound (mol/kg) |
| No. 14 | Copper formate tetrahydrate (1.0) | Copper acetate monohydrate (1.0) | Compound No. 2 (1.2) | Compound No. 15 (1.2) |
| No. 15 | Copper formate tetrahydrate (1.3) | Copper acetate monohydrate (1.3) | Compound No. 2 (1.6) | Compound No. 15 (1.6) |

Example 4

The compounds described in Table 5 were formulated to give the corresponding values (mol/kg) in parentheses, whereby copper film-forming composition Nos. 16 and 17 were obtained as examples of the present invention. It is to be noted that the balance is butanol in its entirety. These copper film-forming composition Nos. 16 and 17 are different in solvent from the copper film-forming composition Nos. 13 and 14 of Example 3.

TABLE 5

| Formulas of Copper Film-forming Compositions of Example 4 | | | | |
|---|---|---|---|---|
| Composition numbers | Copper formate compound (mol/kg) | Copper acetate compound (mol/kg) | Diol compound (mol/kg) | Piperidine compound (mol/kg) |
| No. 16 | Copper formate tetrahydrate (0.5) | Copper acetate monohydrate (0.5) | Compound No. 2 (0.6) | Compound No. 15 (0.6) |
| No. 17 | Copper formate tetrahydrate (1.0) | Copper acetate monohydrate (1.0) | Compound No. 2 (1.2) | Compound No. 15 (1.2) |

Example 5

The compounds described in Table 6 were formulated to give the corresponding values (mol/kg) in parentheses, whereby copper film-forming composition Nos. 18 and 19 were obtained as examples of the present invention. It is to be noted that the balance is ethylene glycol monobutyl ether in its entirety. These copper film-forming composition Nos. 18 and 19 are different in solvent from the copper film-forming composition Nos. 13 and 14 of Example 3 and the copper film-forming composition Nos. 16 and 17 of Example 4.

TABLE 6

| Formulas of Copper Film-forming Compositions of Example 5 | | | | |
|---|---|---|---|---|
| Composition numbers | Copper formate compound (mol/kg) | Copper acetate compound (mol/kg) | Diol compound (mol/kg) | Piperidine compound (mol/kg) |
| No. 18 | Copper formate tetrahydrate (0.5) | Copper acetate monohydrate (0.5) | Compound No. 2 (0.6) | Compound No. 15 (0.6) |
| No. 19 | Copper formate tetrahydrate (1.0) | Copper acetate monohydrate (1.0) | Compound No. 2 (1.2) | Compound No. 15 (1.2) |

Example 6

The compounds described in Table 7 were formulated to give the corresponding values (mol/kg) in parentheses, whereby copper film-forming composition Nos. 20 and 21 were obtained as examples of the present invention. It is to be noted that the balance is diethylene glycol monoethyl ether in its entirety. These copper film-forming composition Nos. 20 and 21 are different in solvent from the copper film-forming composition Nos. 13, 14, and 16 to 19.

TABLE 7

Formulas of Copper Film-forming Compositions of Example 6

| Composition numbers | Copper formate compound (mol/kg) | Copper acetate compound (mol/kg) | Diol compound (mol/kg) | Piperidine compound (mol/kg) |
|---|---|---|---|---|
| No. 20 | Copper formate tetrahydrate (0.5) | Copper acetate monohydrate (0.5) | Compound No. 2 (0.6) | Compound No. 15 (0.6) |
| No. 21 | Copper formate tetrahydrate (1.0) | Copper acetate monohydrate (1.0) | Compound No. 2 (1.2) | Compound No. 15 (1.2) |

Comparative Production Example 3

The compounds described in Table 8 were formulated to give the corresponding values (mol/kg) in parentheses, whereby comparative compositions 12 to 14 in which no copper acetate compound was used were obtained. It is to be noted that the balance is ethanol in its entirety.

TABLE 8

Formulas of Copper Film-forming Compositions of Comparative Production Example 3

| Comparative Composition numbers | Copper formate compound (mol/kg) | Copper acetate compound (mol/kg) | Diol compound (mol/kg) | Piperidine compound (mol/kg) |
|---|---|---|---|---|
| Comp. Compn. 12 | Copper formate tetrahydrate (1.0) | None | Compound No. 2 (1.0) | Compound No. 15 (1.0) |
| Comp. Compn. 13 | Copper formate tetrahydrate (2.0) | None | Compound No. 2 (2.0) | Compound No. 15 (2.0) |
| Comp. Compn. 14 | Copper formate tetrahydrate (2.6) | None | Compound No. 2 (2.6) | Compound No. 15 (2.6) |

Comparative Production Example 4

The compounds described in Table 9 were formulated to give the corresponding values (mol/kg) in parentheses, whereby comparative compositions 15 and 16 in which no copper acetate compound was used were obtained. It is to be noted that the balance is butanol in its entirety. These comparative compositions 15 and 16 are different in solvent from the comparative composition 12 and 13 obtained in Comparative Production Example 3.

TABLE 9

Formulas of Copper Film-forming Compositions of Comparative Production Example 4

| Comparative Composition numbers | Copper formate compound (mol/kg) | Copper acetate compound (mol/kg) | Diol compound (mol/kg) | Piperidine compound (mol/kg) |
|---|---|---|---|---|
| Comp. Compn. 15 | Copper formate tetrahydrate (1.0) | None | Compound No. 2 (1.0) | Compound No. 15 (1.0) |
| Comp. Compn. 16 | Copper formate tetrahydrate (2.0) | None | Compound No. 2 (2.0) | Compound No. 15 (2.0) |

Comparative Production Example 5

The compounds described in Table 10 were formulated to give the corresponding values (mol/kg) in parentheses, whereby comparative compositions 17 and 18 in which no copper acetate compound was used were obtained. It is to be noted that the balance is ethylene glycol monobutyl ether in its entirety. These comparative compositions 17 and 18 are different in solvent from the comparative compositions 12, 13, 15 and 16 obtained in Comparative Production Examples 3 and 4.

TABLE 10

Formulas of Copper Film-forming Compositions of Comparative Production Example 5

| Comparative Compositions | Copper formate compound (mol/kg) | Copper acetate compound (mol/kg) | Diol compound (mol/kg) | Piperidine compound (mol/kg) |
|---|---|---|---|---|
| Comp. Compn. 17 | Copper formate tetrahydrate (1.0) | None | Compound No. 2 (1.0) | Compound No. 15 (1.0) |
| Comp. Compn. 18 | Copper formate tetrahydrate (2.0) | None | Compound No. 2 (2.0) | Compound No. 15 (2.0) |

Comparative Production Example 6

The compounds described in Table 11 were formulated to give the corresponding values (mol/kg) in parentheses, whereby comparative compositions 19 and 20 in which no copper acetate compound was used were obtained. It is to be noted that the balance is diethylene glycol monoethyl ether in its entirety. These comparative compositions 19 and 20 are different in solvent from the comparative composition 12, 13, and 15 to 18 obtained in Comparative Production Examples 3 to 5.

TABLE 11

Formulas of Copper Film-forming Compositions of Comparative Production Example 6

| Comparative Compositions | Copper formate compound (mol/kg) | Copper acetate compound (mol/kg) | Diol compound (mol/kg) | Piperidine compound (mol/kg) |
|---|---|---|---|---|
| Comp. Compn. 19 | Copper formate tetrahydrate (1.0) | None | Compound No. 2 (1.0) | Compound No. 15 (1.0) |
| Comp. Compn. 20 | Copper formate tetrahydrate (2.0) | None | Compound No. 2 (2.0) | Compound No. 15 (2.0) |

Evaluation Example 2

Concerning the copper film-forming composition Nos. 13 to 21 of the examples of the present invention as obtained in Examples 3 to 6 and the comparative compositions 12 to 20 obtained in Comparative Production Examples 3 to 6, the following evaluation was performed by visual observation. First, the conditions of each composition were confirmed. Using a viscometer ("RE-85L"; manufactured by Toki Sangyo Co., Ltd.), the viscosity of the composition was measured. Further, the stability of the composition was confirmed by visually checking its conditions after having been left over in a stoppered vial for 24 hours in the atmosphere. The results are shown all together in Table 12.

TABLE 12

Results of Evaluation on Properties of Compositions

| Evaluation Examples | Copper film-forming compositions | Conditions of composition | Viscosity (Cp) | Stability of composition |
|---|---|---|---|---|
| Comp. Ex. 12 | Comp. compn. 12 | Clear blue liquid | 5.1 | High |
| Comp. Ex. 13 | Comp. compn. 13 | Clear blue liquid | 122.2 | High |
| Comp. Ex. 14 | Comp. compn. 14 | Precipitates were contained[4)] | — | — |
| Comp. Ex. 15 | Comp. compn. 15 | Clear blue liquid | 10.8 | High |
| Comp. Ex. 16 | Comp. compn. 16 | Clear blue liquid | 154.3 | High |
| Comp. Ex. 17 | Comp. compn. 17 | Clear blue liquid | 17.0 | High |
| Comp. Ex. 18 | Comp. compn. 18 | Clear blue liquid | 236.2 | High |
| Comp. Ex. 19 | Comp. compn. 19 | Clear blue liquid | 16.9 | High |
| Comp. Ex. 20 | Comp. compn. 20 | Clear blue liquid | 259.4 | High |
| Eval. Ex. 2-1 | Compn. No. 13 of Ex. 3 | Clear blue liquid | 3.6 | High |
| Eval. Ex. 2-2 | Compn. No. 14 of Ex. 3 | Clear blue liquid | 29.4 | High |
| Eval. Ex. 2-3 | Compn. No. 15 of Ex. 3 | Clear blue liquid | 503.0 | High |
| Eval. Ex. 2-4 | Compn. No. 16 of Ex. 4 | Clear blue liquid | 8.0 | High |
| Eval. Ex. 2-5 | Compn. No. 17 of Ex. 4 | Clear blue liquid | 66.0 | High |
| Eval. Ex. 2-6 | Compn. No. 18 of Ex. 5 | Clear blue liquid | 11.6 | High |
| Eval. Ex. 2-7 | Compn. No. 19 of Ex. 5 | Clear blue liquid | 126.6 | High |
| Eval. Ex. 2-8 | Compn. No. 20 of Ex. 6 | Clear blue liquid | 16.3 | High |
| Eval. Ex. 2-9 | Compn. No. 21 of Ex. 6 | Clear blue liquid | 151.1 | High |

[4)]Unable to dissolve solid matter completely.

As indicated by the results of Table 12, it was able to confirm that, when the copper film-forming composition of each example of the present invention and its corresponding comparative composition were the same in copper concentration and solvent, the copper film-forming composition of the example of the present invention had a lower viscosity and higher stability compared with the comparative composition. As the viscosity of a composition considerably affects the shippability of the composition, it has been found that the copper film-forming composition according to the present invention is excellent in shippability and high in stability. Further, it was impossible to dissolve copper formate tetrahydrate, which is a solid matter, completely in Comparative Example 14, while it was possible to completely dissolve the solid matter in Evaluation Example 2-3 in which the concentration of copper in the composition was the same as that of copper in the composition of Comparative Example 14. According to the present invention, the provision of a composition of high copper concentration is hence feasible.

Example 7

Separately using the copper film-forming composition Nos. 13 to 21 obtained in Examples 3 to 6, the production of thin copper films by a coating method was conducted. Described specifically, each composition was first cast on a similar glass substrate ("Eagle XG", product of Corning Incorporated) as those used in Example 2, and was coated at 500 rpm for 5 seconds and then at 2,000 rpm for 20 seconds by spin coating. Subsequently, the glass substrate was dried at 140° C. for 30 seconds on a hot plate in the atmosphere, and was then heated at a temperature of 250° C. for 20 minutes under an argon atmosphere in an infrared heating furnace ("RTP-6"; manufactured by ULVAC-RIKO, Inc.) to conduct primary heating. During the primary heating, the flow condition for argon was set at 300 mL/min, and the ramp-up rate was set at 250° C./30 sec.

Comparative Production Example 7

Separately using the comparative compositions 12 to 20 obtained in Comparative Production Examples 3 to 6, the production of thin copper films by a coating method was conducted. Described specifically, each composition was first cast on a similar glass substrate ("Eagle XG", product of Corning Incorporated) as those used in Example 2, and was coated at 500 rpm for 5 seconds and then at 2,000 rpm for 20 seconds by spin coating. Subsequently, the glass substrate was dried at 140° C. for 60 seconds on a hot plate in the atmosphere, and the glass substrate after the drying was then heated at 250° C. for 20 minutes under an argon atmosphere in an infrared heating furnace ("RTP-6"; manufactured by ULVAC-RIKO, Inc.) to conduct primary heating. During the primary heating, the flow condition for argon was set at 300 mL/min, and the ramp-up rate was set at 250° C./30 sec.

Evaluation Example 3

Concerning the thin copper films obtained in Example 7 and Comparative Production Example 7, an evaluation was performed for film conditions, surface resistivity and film thickness by the below-described methods. The conditions of each film were evaluated by a visual observation. For the measurement of the surface resistivity of each film, "LORESTA GP" (manufactured by Mitsubishi Chemical Analytech Co., Ltd.) was used. The thickness of each film was measured by observing its cross-section with FE-SEM. The results are shown in Table 13.

TABLE 13

Results of Evaluation

| Evaluation Examples | Copper film-forming compositions | Film conditions | Surface resistivity (Ω/□) | Film thickness (nm) |
|---|---|---|---|---|
| Comp. Ex. 21 | Comp. compn. 12 | Smooth, glossy over entire surface | 3.3 | 160 |
| Comp. Ex. 22 | Comp. compn. 13 | Rough, sea-island form[6)] | 6.2 | 490 |
| Comp. Ex. 23 | Comp. compn. 14 | 5) | — | — |
| Comp. Ex. 24 | Comp. compn. 15 | Smooth, glossy over entire surface | 58.2 | 100 |
| Comp. Ex. 25 | Comp. compn. 16 | Rough, sea-island form[6)] | 1.3 | 560 |
| Comp. Ex. 26 | Comp. compn. 17 | Smooth, glossy over entire surface | 31.0 | 130 |
| Comp. Ex. 27 | Comp. compn. 18 | Rough, sea-island form[6)] | 1.0 | 340 |
| Comp. Ex. 28 | Comp. compn. 19 | Smooth, glossy over entire surface | 63.0 | 100 |
| Comp. Ex. 29 | Comp. compn. 20 | Rough, sea-island form[6)] | 3.6 | 1460 |
| Eval. Ex. 3-1 | Compn. No. 13 of Ex. 7 | Smooth, glossy over entire surface | 3.0 | 170 |
| Eval. Ex. 3-2 | Compn. No. 14 of Ex. 7 | Smooth, glossy over entire surface | 0.3 | 480 |
| Eval. Ex. 3-3 | Compn. No. 15 of Ex. 7 | Smooth, glossy over entire surface | 0.1 | 940 |
| Eval. Ex. 3-4 | Compn. No. 16 of Ex. 7 | Smooth, glossy over entire surface | 19.4 | 110 |
| Eval. Ex. 3-5 | Compn. No. 17 of Ex. 7 | Smooth, glossy over entire surface | 0.7 | 440 |
| Eval. Ex. 3-6 | Compn. No. 18 of Ex. 7 | Smooth, glossy over entire surface | 22.9 | 90 |
| Eval. Ex. 3-7 | Compn. No. 19 of Ex. 7 | Smooth, glossy over entire surface | 0.7 | 420 |
| Eval. Ex. 3-8 | Compn. No. 20 of Ex. 7 | Smooth, glossy over entire surface | 21.0 | 150 |
| Eval. Ex. 3-9 | Compn. No. 21 of Ex. 7 | Smooth, glossy over entire surface | 0.5 | 464 |

5) It was impossible to form a thin film because precipitates had occurred in the composition.

[6)]The composition was repelled on the substrate upon application, thereby making it impossible to form a film over the entire surface of the substrate.

From the results of Table 13, it was able to confirm, through a comparison between the copper films formed by applying each comparative composition and its corresponding composition of the example according to the present invention both of which were the same in copper concentration and solvent, that the copper film obtained by using the copper film-forming composition of the example of the present invention was substantially lower in surface resistivity and was improved in electrical characteristics compared with the copper film obtained by using the comparative composition. It was also confirmed that, from the copper film-forming compositions of the examples of the present invention in which the various organic solvents were used, similar results were obtained irrespective of the kinds of the organic solvents. Even when copper films were formed with the copper film-forming compositions of the examples of the present invention in which the copper concentrations were as high as 2.0 mol/kg or higher, smooth films were obtained. It has, therefore, been found that the copper film-forming composition according to the present invention can retain good coating properties even when its copper concentration is high.

The invention claimed is:

1. A copper film-forming composition comprising, as essential components, 0.01 to 3.0 mol/kg of copper formate or a hydrate thereof, 0.01 to 3.0 mol/kg of copper acetate or a hydrate thereof, at least one diol compound selected from the group consisting of diol compounds represented by the below-described formula (1) and diol compounds represented by the below-described formula (1'), a piperidine compound represented by the below-described formula (2), and an organic solvent with the copper formate or the hydrate thereof, the copper acetate or the hydrate thereof, the at least one diol compound and the piperidine compound dissolved therein, wherein, when a content of the copper formate or the hydrate thereof is assumed to be 1 mol/kg, the diol compound is contained in a range of 0.1 to 6.0 mol/kg and the piperidine compound is contained in a range of 0.1 to 6.0 mol/kg:

Formula (1)

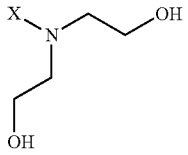

Formula (1')

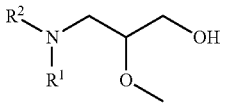

wherein X denotes a hydrogen atom, methyl group, ethyl group or 3-aminopropyl group, and $R^1$ and $R^2$ each independently indicate a hydrogen atom or an alkyl group having 1 to 4 carbon atoms or may be fused together to form a 5-membered ring or 6-membered ring in combination with the adjacent nitrogen atom, and Formula (2)

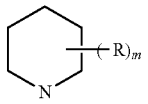

wherein R represents a methyl group or ethyl group, and m stands for 0 or 1.

2. The copper film-forming composition according to claim 1, wherein the diol compound comprises at least one diolamine selected from the group consisting of N-methyldiethanolamine, diethanolamine, N-ethyldiethanolamine and N-aminopropyldiethanolamine.

3. The copper film-forming composition according to claim 1, wherein the diol compound is N-methyldiethanolamine.

4. The copper film-forming composition according to claim 1, wherein the piperidine compound is 2-methylpiperidine.

5. The copper film-forming composition according to claim 1, wherein the content of the copper formate or the hydrate thereof is 0.1 to 2.5 mol/kg, and a content of the copper acetate or the hydrate thereof is 0.1 to 2.5 mol/kg; and, when the content of the copper formate or the hydrate thereof is assumed to be 1 mol/kg, the diol compound is contained in a range of 0.2 to 5.0 mol/kg and the piperidine compound is contained in a range of 0.2 to 5.0 mol/kg.

6. The copper film-forming composition according to claim 1, wherein a sum of the contents of the diol compound and piperidine compound is in a range of 0.5 to 2.0 mol/kg when a sum of the copper formate and copper acetate is assumed to be 1 mol/kg.

7. The copper film-forming composition according to claim 1, wherein the organic solvent comprises at least one organic solvent selected from the group consisting of alcohol-based solvents, diol-based solvents and ester-based solvents.

8. A process for producing a copper film, comprising the following steps:

applying, onto a substrate, the copper film-forming composition according to claim 1, and then heating the substrate at 100 to 400° C. to form the copper film.

* * * * *

UNITED STATES PATENT AND TRADEMARK OFFICE

CERTIFICATE OF CORRECTION

PATENT NO. : 9,028,599 B2
APPLICATION NO. : 14/452895
DATED : May 12, 2015
INVENTOR(S) : Tetsuji Abe It is certified that error appears in the above-identified patent and that said Letters Patent is hereby corrected as shown below:

Title Page, Item (57), Abstract

Please change:

Provided is a copper film-forming composition, which is in the form of a solution and can obtain a copper film having sufficient electrical conductivity when heated at a relatively low temperature. This copper film-forming composition contains 0.01 to 3.0 mol/kg of copper formate or its hydrate, 0.01 to 3.0 mol/kg of copper acetate or its hydrate, at least one diol compound selected from a group of diols of formula (1) and diols of formula (1'), a piperidine compound of formula (2), and an organic solvent. When a content of the copper formate or its hydrate is assumed to be 1 mol/kg, the diol compound is contained in a range of 0.1 to 6.0 mol/kg and the piperidine compound is contained in a range of 0.1 to 6.0 mol/kg.

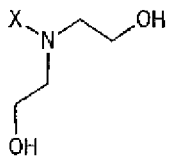

Formula (1)

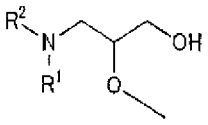

Formula (1')

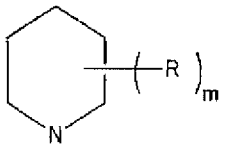

Formula (2)

Signed and Sealed this
First Day of March, 2016

Michelle K. Lee

Michelle K. Lee
*Director of the United States Patent and Trademark Office* to:

Provided is a copper film-forming composition, which is in the form of a solution and can obtain a copper film having sufficient electrical conductivity when heated at a relatively low temperature. This copper film-forming composition contains 0.01 to 3.0 mol/kg of copper formate or its hydrate, 0.01 to 3.0 mol/kg of copper acetate or its hydrate, at least one diol compound selected from a group of diols of formula (1) and diols of formula (1'), a piperidine compound of formula (2), and an organic solvent. When a content of the copper formate or its hydrate is assumed to be 1 mol/kg, the diol compound is contained in a range of 0.1 to 6.0 mol/kg and the piperidine compound is contained in a range of 0.1 to 6.0 mol/kg.

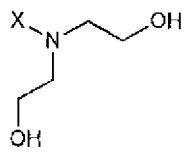

Formula (1)

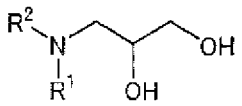

Formula (1')

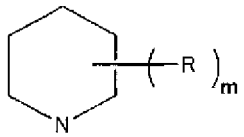

Formula (2)

In the Claims

<u>Claim 1, Col. 25, Lines 39-45</u>

Please change:

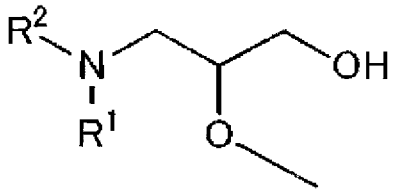

Formula (1')

to:

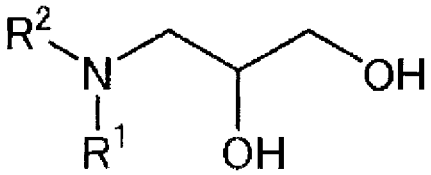

Formula (1')